US007681757B2

(12) United States Patent
Rose et al.

(10) Patent No.: US 7,681,757 B2
(45) Date of Patent: Mar. 23, 2010

(54) METHOD FOR TRANSPORT OF HEAT-SENSITIVE LIQUIDS

(76) Inventors: J. Michael Rose, 2646 S. Loop W., Ste. 405, Houston, TX (US) 77054; Kim Grant, Dept. 302, P.O. Box 60326, Houston, TX (US) 77205

( * ) Notice: Subject to any disclaimer, the term of this patent is extended or adjusted under 35 U.S.C. 154(b) by 1153 days.

(21) Appl. No.: 11/284,607

(22) Filed: Nov. 22, 2005

(65) Prior Publication Data

US 2007/0116811 A1 May 24, 2007

(51) Int. Cl.
*B67B 7/00* (2006.01)

(52) U.S. Cl. ..... 222/1; 426/389; 426/411; 222/146.5; 222/105; 222/152; 222/183; 222/394

(58) Field of Classification Search ..... 222/1, 222/146.2, 146.4, 105, 146.5, 152, 183, 394–395; 165/46, 169; 426/564, 389, 411–413; 219/657, 219/771–772

See application file for complete search history.

(56) References Cited

U.S. PATENT DOCUMENTS 1,533,587 A * 4/1925 Durborow ..... 222/152
1,767,680 A * 6/1930 Hutt ..... 222/146.4
3,945,534 A * 3/1976 Ady ..... 222/105
4,004,040 A * 1/1977 Puta ..... 426/564
4,613,053 A * 9/1986 Kimura et al. ..... 220/530
5,385,142 A * 1/1995 Brady et al. ..... 128/204.23
5,613,622 A * 3/1997 Surrena et al. ..... 222/105
5,884,814 A * 3/1999 Nelson ..... 222/146.2
6,550,645 B2 * 4/2003 Nelson et al. ..... 222/105

* cited by examiner

*Primary Examiner*—Kevin P Shaver
*Assistant Examiner*—Andrew P Bainbridge
(74) *Attorney, Agent, or Firm*—John R. Casperson

(57) ABSTRACT

A specially designed flexible tank is installed in a standard 20 foot overseas shipping container or in a standard trucking dry van trailer. A conductive heat serpentine plastic tubing system is also installed underneath the flexible tank allowing heat to liquefy the honey near the bottom discharge location. Nitrogen is introduced through an upper air purging valve and flow is controlled by a regulator allowing tank to stand and not be conducive to cling of product on the roof or the sidewalls and to assist in discharging product without need of a pumping mechanism. Due to the continued shape of the flexible tank there will be very little product loss allowing virtually all product to be expelled. The discharge valve will remain open when the heat is started and this allows the honey to be removed as quickly as it becomes liquid. The method permits bulk shipped honey to be unloaded without substantial increase in HMF levels or air entrainment caused by pumping which could lead to crystallization, and avoids substantial product loss due to clinging on the inside of the tank. The invention also provides substantial labor savings along with freight savings compared to the prior honey industry method of shipping honey in 55 gallon drums.

17 Claims, 1 Drawing Sheet

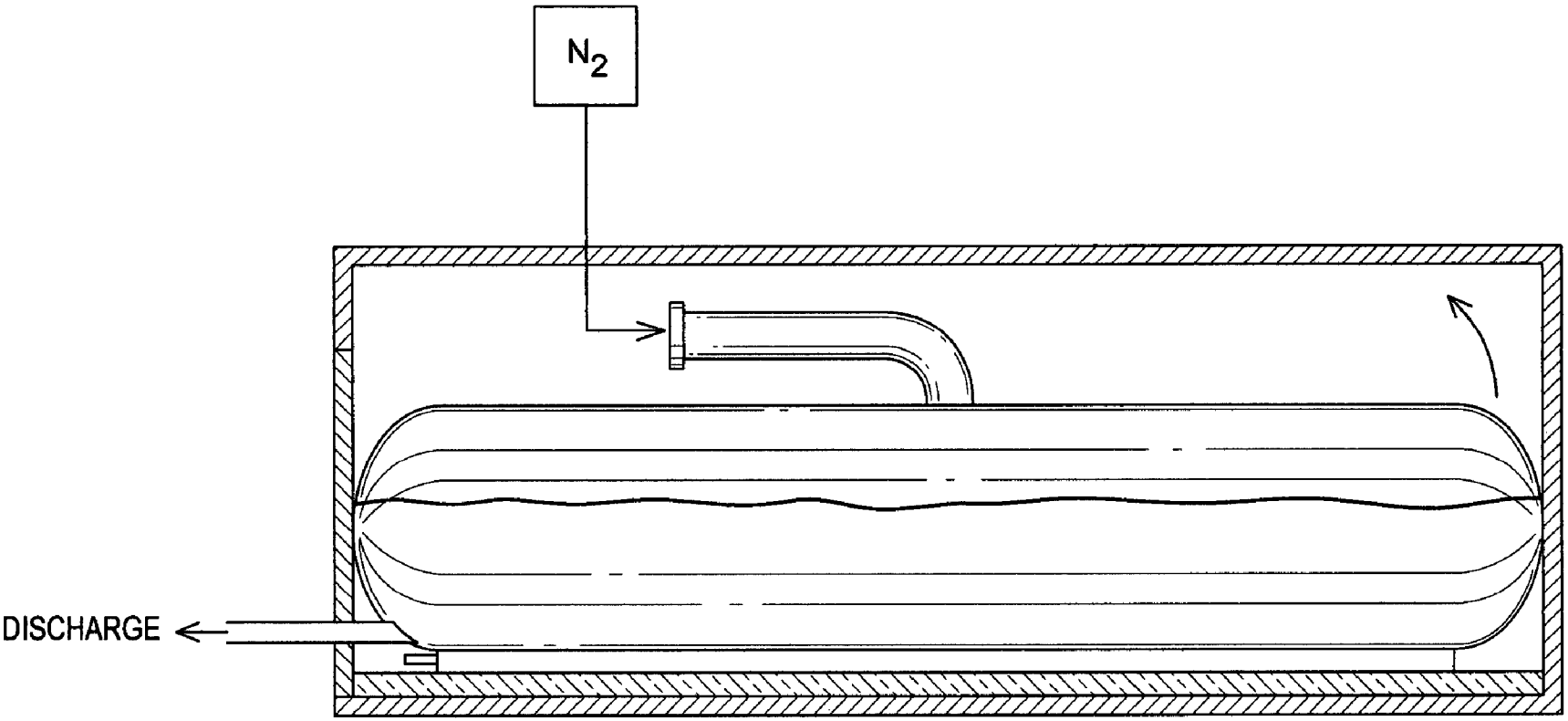
FIGURE

METHOD FOR TRANSPORT OF HEAT-SENSITIVE LIQUIDS

FIELD OF THE INVENTION

This invention relates generally to methods for transporting, heating and unloading heat sensitive liquids such as bee honey.

BACKGROUND OF THE INVENTION

The consumption of honey is well established all over the world as a healthy and very nutritional energy source. Honeys come in various forms based on floral source, area of collection, moisture and the honey's ability to crystallize. They differ in color, moisture, pollen content and also its ability to crystallize at different stages after collection. Honey is susceptible to crystallization which occurs naturally, a process in which the glucose molecules form crystals with some of the water molecules. Crystallization is affected by three major factors. One is the floral origin of the nectar. Generally, honeys with a high glucose/fructose ratio, will crystallize more rapidly than honeys with a relatively low glucose/fructose ratio. Crystallization can also be triggered by small air bubbles suspended in the product by handling and pumping practices. Honeys may crystallize in just a few days or over a period of weeks and months.

Honey is also susceptible to hydroxy-methyl-furfural (HMF) buildup which is formed during the thermal decomposition of sugars and carbohydrates. HMF has been identified in a wide variety of heat processed foods including milk, fruit juices, and spirits, and it occurs naturally in honey over time or more quickly in honey that has been exposed to heat or honey which occurs in climates that speed up this process.

New honey contains 1 to 5 mg/kg HMF. In many parts of Europe, it is forbidden to sell honey with more than 40 mg/kg HMF. When honey is being stored at 20° C. the HMF content will raise +/−1 mg/kg per month. Only the fructose component will become HMF. So the rise is also dependent on the kind of honey!

Heating the honey will raise HMF levels rapidly. The longer and/or hotter it is heated, the higher the HMF will become. This temperature dependence is shown in the following table.

Table of the time to produce 30 ppm HMF

| Temperature in ° C. | Temperature in ° F. | Time in days |
|---|---|---|
| 30 | 86 | 150–200 |
| 40 | 104 | 20–50 |
| 50 | 122 | 4.5–9 |
| 60 | 140 | 1–2.5 |
| 70 | 158 | 5–14 hours |

These characteristics above and considering honey's sticky characteristics make it very difficult to move or transport it and then to receive it into commercial facilities for processing. Transportation and processing are therefore very labor-intensive and costly. Many countries are shipping large amounts of honey product all over the world. Traditionally, honey product has been moved in 55 gallon drums requiring substantial labor and extra costs due to the handling of the drums and heating them to remove the product. The current system with drums is very inefficient and expensive when considering that every shipping container contains one metric ton of metal contained in the drums, and this adds substantially to freight charges.

Draining the honey from containers presents its own set of problems. Honey has very different viscosities depending on floral source and time and temperature and is prone to crystallize thereby becoming even more difficult to work with and remove. Honey which has crystallized can become solid and is very difficult to remove from the container by gravity or pumping. Heating the product for longer periods of time is required and this can cause HMF levels to rise and ruin some of the quality and value of a particular honey product.

Honey is a very delicate product and under normal pumping practices air is introduced or is agitated into the product through cavitation in the pump or violent discharge into holding tanks. All of these methods produce tiny air bubbles that are suspended in the honey and can help form crystallization that is not desired.

These factors together have discouraged those in the honey business from attempting bulk or intermediate-bulk shipment methods, for example, shipping honey in containers of 1-24 metric tons, or utilizing containers carrying an internal collapsible container since the clinging of the product would cause the loss of a large amount of product which cannot be removed when the internal container collapses.

A procedure to ship honey in a collapsible container which prevents the collapsible container from collapsing on itself would reduce waste and make bulk shipments more feasible.

A procedure which permits the honey to be removed from the container with minimal heat input would avoid HMF buildup and possible product loss in that manner.

A procedure to remove the product quickly and easily and not create pumping agitation that has been known to cause seeding of air bubbles and inducing crystallization much more rapidly would preserve product quality, and would therefore be desirable.

A procedure for bulk shipping honey product would avoid the expenses of the concomitant shipment of large amounts of weight in the form of drums and the labor costs for manhandling the drums, and would therefore be desirable.

SUMMARY OF THE INVENTION

In accordance with the invention, there is provided a method for discharging a heat-sensitive viscous liquid such as honey from a hard-sided container. The method is carried out on a hard sided container containing a flexible bladder carrying the liquid, with a heating pad positioned between the bottom of the bladder and the bottom of the hard sided container. An outer wall of the bladder is supported by an inner wall of the hard-sided container. The method comprises energizing the heating pad, pressurizing the upper end of the bladder, and discharging the heat-sensitive viscous liquid from a lower end of the bladder.

When the process steps are carried out simultaneously, heat absorption by the product is minimized, and this minimizes HMF buildup. Mechanical pumping of the product can be avoided by combining gravitational forces with a pressure head to provide adequate motive force for discharge. When the bladder is pressurized adequately to hold the top of the bladder apart from an upper surface of the liquid, loss of product due to collapse of the bladder is avoided by giving time for the material clinging to the sidewall to drain into the body of the product. The method thus overcomes prior limitations which had prevented bulk shipments of product such as bee honey.

BRIEF DESCRIPTION OF THE DRAWING

The FIGURE is an elevated side view, partly in cross section, of a flexible bladder carrying honey, within a shipping container.

DETAILED DESCRIPTION OF THE INVENTION

In accordance with the invention, there is provided a method for discharging a heat-sensitive viscous liquid such as honey from a hard-sided container. The method is carried out on a hard sided container containing a flexible bladder carrying the liquid, with a heating pad positioned between the bottom of the bladder and the bottom of the hard sided container. An outer wall of the bladder is supported by an inner wall of the hard-sided container. The method comprises energizing the heating pad, pressurizing the upper end of the bladder, and discharging the heat-sensitive viscous liquid from a lower end of the bladder.

Examples of hard sided containers are bulk shipping containers, which can carry up to 24 metric tons of product, intermediate bulk shipping containers, which carry in the range of 1,000 to 1,500 kilograms of product, and other self-standing containers such as reinforced containers and shipping compartments.

In a preferred embodiment, the upper end of the bladder is pressurized by injection of an inert gas, such as nitrogen gas, so as to provide an internal pressure in the range of 0.5 to 5 psig, more preferably 1 to 2 psig. Functionally speaking, the bladder is pressurized adequately to hold the top of the bladder apart from an upper surface of the liquid, and more preferably, adequately to provide a significant part of the motive force for the discharge of the contents of the bladder. Pressurization can be conducted from a cylinder of compressed gas via a regulator valve constantly supplying the correct pressure and volume.

In a preferred embodiment, the heating pad is energized with a fluid selected from the group consisting of hot water and steam. More preferably, the heating pad comprises a serpentine tubing for carrying the fluid.

The combination of heat and pressurization permits the liquid to be withdrawn without the input of mechanical agitation, which is especially desirable in the case of honey.

In a most preferred embodiment, the steps of energizing the heating pad, pressuring an upper end of the bladder, and withdrawing the heat-sensitive viscous liquid from the lower end of the bladder, are carried out simultaneously. The method is preferably conducted so that only the liquid near the lower end of the bladder undergoes substantial viscosity decrease, as this approach minimizes prolonged heating of the overall product or possible overheating of a portion of it, as the product can be discharged promptly after being heated sufficiently to flow to a discharge port.

To assist in recovering residual liquid from the bladder, the bottom of the container and/or the bladder can be inclined to pool the residual liquid around the pickup. To this end, the bladder can be positioned independently from the container to a limited extent. For example, the bladder can be provided with handles so that it can be partly lifted or rolled when in a substantially empty state to pool the residual liquid around the discharge pickup. In a shipping container application, for example, once the bladder has been discharged down to the final one or two percent of product, two draw strings or straps passing through two ceiling eyes and attached to the far end of the bladder on each corner can be pulled backwards through the container doors to lift the far end of the bladder, which is self-supporting due to the pressurization, and pool the liquid around a discharge pickup positioned near the container doors.

The invention is expected to provide good benefits when applied to a viscous liquid comprising at least one sugar selected from the group consisting of glucose, fructose and sucrose. The invention is expected to provide greater benefits when applied to a viscous liquid comprising fructose, since its application will help avoid unnecessary HMF buildup. The invention is expected to provide its greatest benefits when applied to bee honey for the reasons mentioned herein, and chocolates. However, the invention will also provide good benefits generally when applied to liquids that have become viscous during shipment, due to cooling or aging, for example, and that can be made to flow upon heating. For example, it can be beneficial to transport oils, greases, and fats, especially edible ones, in accordance with certain aspects of the invention.

The invention permits bulk shipment of bee honey, for example, shipments of bladders containing at least one metric ton of bee honey. More preferably, the hard-sided container comprises an overseas shipping container, and the bladder is sized to fit.

Further Description of Preferred Embodiments

The disclosure of U.S. Pat. No. 5,884,814 is incorporated herein by reference. The apparatus as disclosed therein, with suitable modifications, can be used to carry the method of the invention. The modifications are: (1) honey, (or similar product such as glucose, fructose, sucrose, dextrose chocolates, liquid sugar, and various other products that thicken or cling in a similar fashion in a cooled situation or over time and/or that may be affected by HMF) is the contained product, (2) a means is provided for injecting nitrogen (or other nonreactive gas) into the upper end of the bladder to provide a pressure in the range of 0.5 to 5 pounds per square inch, preferably 1-2 psig, (3) the shipping container sidewalls are lined with cardboard (or other soft insulating panels such as foam insulation) prior to positioning the bladder, (4) the bladder is provided with a bottom discharge, and (5) the end of the bladder away from the container doors is provided with straps which permit it to be elevated once the bladder is substantially emptied.

As an example, a three-ply, co-extruded flexible tank is installed in a standard 20 foot overseas shipping container (or a standard trucking dry van) after proper cleaning and preparation with protective cardboard lining and bulk head. A serpentine heating unit is installed underneath the flexible tank, to be connected at the final destination to a source of steam or hot water. The flexible tank is designed in a rectangular shape that will continue holding its shape as nitrogen is released, via a regulator valve, into the upper purging valve to provide a head of 1-2 psig, for example, 1.5 psig. The nitrogen will not only support the tank material in its original shape, preventing honey cling to the roof, but will also push the product out the bottom discharge through a two-inch bottom discharge valve. This valve will be opened at the same time as heating commences allowing product to leave the container as quickly as it becomes liquid allowing for minimal effects from heat transfer. Heating the entire contents of the bladder to a temperature which provides satisfactory flowability prior to discharge but would unnecessarily increase HMF level is thereby avoided. Once the bladder is substantially empty, the end away from the discharge pickup can be elevated to permit the residual honey to pool around the discharge pickup for removal.

This system minimizes product cling to the roof or walls as it provides for product draining immediately as it heat liquefies and is removed by the nitrogen pressure and gravity to the lowest discharge valve and into the customer's storage container. This allows for the product to have contact with heat for the least possible time and insuring excellent quality of the product and limits agitation that can induce air bubbles and cause more product crystallization.

Allowing for the container to stand and not collapsible itself allows the product to be removed easier by using low-pressure nitrogen to keep the flexible tank inflated and actually push the product out of the container. Constant nitrogen pressure provided via a regulator valve insures quick removal of product and pushing product with 1-2 psig, for example, 1.5 psig will remove the product quickly and easily and not create pumping agitation that has been known to cause seeding of air bubbles which induce crystallization much more rapidly.

Since honey is very delicate with respect to heat, the ability to heat the product slowly by the serpentine heat exchanger mentioned earlier and push it with the continued pressure of the nitrogen gas through the bottom discharge valve avoids an unnecessary increase in HMF which could lead to a significant drop in product value or a possible rejection by the client.

The invention provides a specially designed flexible tank for the honey industry. It may also be useful for other similar products, for example, glucose, fructose, sucrose, dextrose chocolates, liquid sugars and various others that thicken or cling in a similar fashion in a cooled situation or over time and that may be affected by HMF. A three ply co extruded flexible tank is installed in a standard 20 foot overseas shipping container (or a standard trucking dry van) after proper cleaning and preparation with a protective cardboard lining and bulk head. A serpentine heating unit is installed underneath the flexible tank, to be connected at final destination to steam or hot water. The flexible tank is designed in a rectangular shape that will continue holding its shape as 1.5 pounds of nitrogen is released into an upper purging valve and is controlled by a regulating valve. The nitrogen will not only support the tank material in its original shape, preventing cling, but will push the product out at a substantial flow with 1.5 pounds per square inch of force per square inch on the product which is discharged through a two inch bottom discharge valve. This valve will be opened at the same time as heating is commenced allowing product to leave the container as quickly as it becomes liquid allowing for minimal effects from the heat transfer.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. A method for discharging a heat-sensitive viscous liquid from a hard-sided container, said method comprising:

providing a hard-sided container, providing a flexible bladder containing the heat sensitive viscous liquid in the hard-sided container, an outer wall of the bladder being supported by an inner wall of the hard-sided container, providing a heating pad between a bottom of the flexible bladder and a bottom of the hard-sided container, energizing the heating pad, internally pressuring an upper end of the bladder adequately to hold the top of the bladder apart from an upper surface of the liquid, and discharging the heat-sensitive viscous liquid from a lower end of the bladder.

2. A method as in claim 1 wherein the upper end of the bladder is pressurized by injection of an inert gas.

3. A method as in claim 2 wherein the upper end of the bladder is pressurized with nitrogen gas.

4. A method as in claim 2 further comprising regulating the injection of inert gas so as to maintain a pressure in the range of 0.5 to 5 psig.

5. A method as in claim 4 wherein the upper end of the bladder is pressurized with nitrogen gas, further comprising regulating the injection of nitrogen gas so as to maintain a pressure in the range of 1 to 2 psig.

6. A method as in claim 3 wherein the heating pad is energized with a fluid selected from the group consisting of hot water and steam.

7. A method as in claim 1 wherein the steps of energizing the heating pad, pressuring an upper end of the bladder, and discharging the heat-sensitive viscous liquid from the lower end of the bladder, are carried out simultaneously.

8. A method as in claim 1 wherein the viscous liquid comprises at least one sugar selected from the group consisting of glucose, fructose and sucrose.

9. A method as in claim 8 wherein the viscous liquid comprises fructose.

10. A method as in claim 9 wherein the viscous liquid comprises bee honey.

11. A method as in claim 10 wherein the bladder contains at least one metric ton of bee honey.

12. A method as in claim 11 which is conducted so that only the liquid near the lower end of the bladder undergoes substantial viscosity decrease.

13. A method as in claim 12 wherein the honey is withdrawn without the input of mechanical agitation or pumping.

14. A method as in claim 1 wherein the hard-sided container is selected from the group consisting of an overseas shipping container and an intermediate bulk container.

15. A method as in claim 7 further comprising inclining the bottom of at least one of the container and the bladder to pool residual liquid around a discharge pickup positioned near the bottom of the bladder.

16. A method as in claim 15 further comprising elevating an end of the bladder away from the discharge pickup to pool residual liquid around the discharge pickup once the bladder has been substantially emptied.

17. A method as in claim 1 wherein the heat sensitive viscous liquid is selected from the group consisting of chocolate, grease, fat and oil.

* * * * *